US010043472B2

(12) United States Patent
Wang et al.

(10) Patent No.: US 10,043,472 B2
(45) Date of Patent: Aug. 7, 2018

(54) DIGITAL COMPENSATION FOR V-GATE COUPLING

(71) Applicant: Apple Inc., Cupertino, CA (US)

(72) Inventors: Chaohao Wang, Sunnyvale, CA (US); Paolo Sacchetto, Cupertino, CA (US); Howard H. Tang, San Diego, CA (US)

(73) Assignee: Apple Inc., Cupertino, CA (US)

( * ) Notice: Subject to any disclaimer, the term of this patent is extended or adjusted under 35 U.S.C. 154(b) by 169 days.

(21) Appl. No.: 14/976,853

(22) Filed: Dec. 21, 2015

(65) Prior Publication Data

US 2016/0111054 A1 Apr. 21, 2016

Related U.S. Application Data

(60) Provisional application No. 62/209,747, filed on Aug. 25, 2015.

(51) Int. Cl.
*G09G 3/36* (2006.01)

(52) U.S. Cl.
CPC ..... *G09G 3/3655* (2013.01); *G09G 2300/043* (2013.01); *G09G 2300/0426* (2013.01); *G09G 2310/0281* (2013.01); *G09G 2310/08* (2013.01); *G09G 2320/0209* (2013.01)

(58) Field of Classification Search
CPC ..... G09G 3/3655; G09G 2300/0426; G09G 2300/043; G09G 2310/0281; G09G 2310/08
See application file for complete search history.

(56) References Cited

U.S. PATENT DOCUMENTS

| | | | | |
|---|---|---|---|---|
| 8,451,262 | B2 | 5/2013 | Lee et al. | |
| 2007/0046804 | A1* | 3/2007 | Hirano | H04N 5/23293 348/333.01 |
| 2007/0115226 | A1* | 5/2007 | Jung | G09G 3/3233 345/76 |
| 2008/0225027 | A1 | 9/2008 | Toyomura et al. | |
| 2010/0128028 | A1* | 5/2010 | Lee | G09G 3/3677 345/214 |
| 2012/0013635 | A1* | 1/2012 | Beeman | G09G 3/2003 345/590 |
| 2014/0062331 | A1 | 3/2014 | Nam et al. | |
| 2014/0104155 | A1 | 4/2014 | Long et al. | |
| 2014/0152938 | A1* | 6/2014 | Lee | G09G 3/3648 349/46 |

* cited by examiner

*Primary Examiner* — Ariel Balaoing
(74) *Attorney, Agent, or Firm* — Fletcher Yoder PC

(57) ABSTRACT

A display device may include a source line that provides a data line signal to a pixel of the display device, a gate line that provides a gate signal to a switches associated with the pixel, and a voltage gate line disposed parallel to the source line and coupled to the gate line at a cross point node. The display device may also include a driver circuit that receives a pixel value to provide to the pixel, determines a compensation amount for the pixel value based on an expected kickback voltage present on the pixel due to a coupling effect between the source line and the voltage gate line, generates a compensated data line signal based on the compensation value and the pixel value, and provides the compensated data line signal to the pixel via the source line.

19 Claims, 9 Drawing Sheets

DIGITAL COMPENSATION FOR V-GATE COUPLING

CROSS REFERENCE TO RELATED APPLICATIONS

This application is a Non-Provisional patent application of U.S. Provisional Patent Application No. 62/209,747, entitled "Digital Compensation for V-Gate Coupling", filed Aug. 25, 2015, which are herein incorporated by reference.

BACKGROUND

The present disclosure relates generally to electronic display devices that depict image data. More specifically, the present disclosure relates to systems and methods for digitally compensating for coupling effects that may be present in electronic display devices.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

As electronic displays are employed in a variety of electronic devices, such as mobile phones, televisions, tablet computing devices, and the like, manufacturers of the electronic displays continuously seek ways to improve the design of the electronic display. For example, the size of a bezel region that surrounds a display panel of an electronic display has steadily decreased with improved circuitry in the electronic display. In some cases, however, the reduced bezel region may be accompanied with certain undesirable visual effects. As such, it is desirable to identify various systems and methods that may compensate for the undesirable visual effects that may be present on various electronic displays.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

An electronic display may reduce the size of its bezel region by employing certain electronic circuitry to drive the pixels of the electronic display. Often times, the circuitry of the electronic display may include a gate driver integrated circuit (IC) and a column driver IC (e.g., column driver IC). Generally, the gate driver IC couples voltages across gate lines that run in one direction (e.g., horizontally) across a display panel of the electronic display, while the column driver IC couples data line signals (e.g., gray level) to source lines that run in another direction (e.g., vertically) across the display panel. In combination, the gate driver IC and the column driver IC may illuminate pixels in the display panel to display desired image data that may be provided via a processor. In some instances, the gate driver IC may be may be placed on one side (e.g., along vertical edge) of the electronic display and the column driver IC may be placed on another side (e.g., along horizontal edge) of the electronic display to drive the gate lines and source lines, respectively.

To reduce the size of the bezel region surrounding the display panel, in one embodiment, the gate driver IC and the column driver IC may be co-located along one side of the electronic display. That is, the gate driver IC and the column driver IC may both be located adjacent to a horizontal edge or a vertical edge of the display panel. However, when placing both the gate driver IC and the column driver IC on the same side of the electronic display additional wiring will be provided in the display panel, such that the gate driver IC may couple to the appropriate gate lines. The additional wiring (e.g., voltage gate lines, v-gate lines) may be parallel to the source lines. However, due to the proximity between the parallel v-gate lines and the source lines, certain pixels may experience a coupling effect that may alter voltage signals received by the pixels via the respective source lines due to the voltage signals present on the v-gate lines.

With the foregoing in mind, in certain embodiments, the gate driver IC and/or the column driver IC may include logic that may modify the data line signals provided to certain pixels of the display panel to compensate for the coupling effect that may be present on the respective pixel. That is, the logic may increase or decrease an amplitude or value of the data line signal provided to a certain pixel based on an expected coupling effect for the respective pixel. As a result, the undesired visual effects that may occur due to the coupling effect between the source lines and the v-gate lines may be minimized, thereby improving the quality of the image data depicted on the display panel while minimizing the bezel region of the electronic display.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
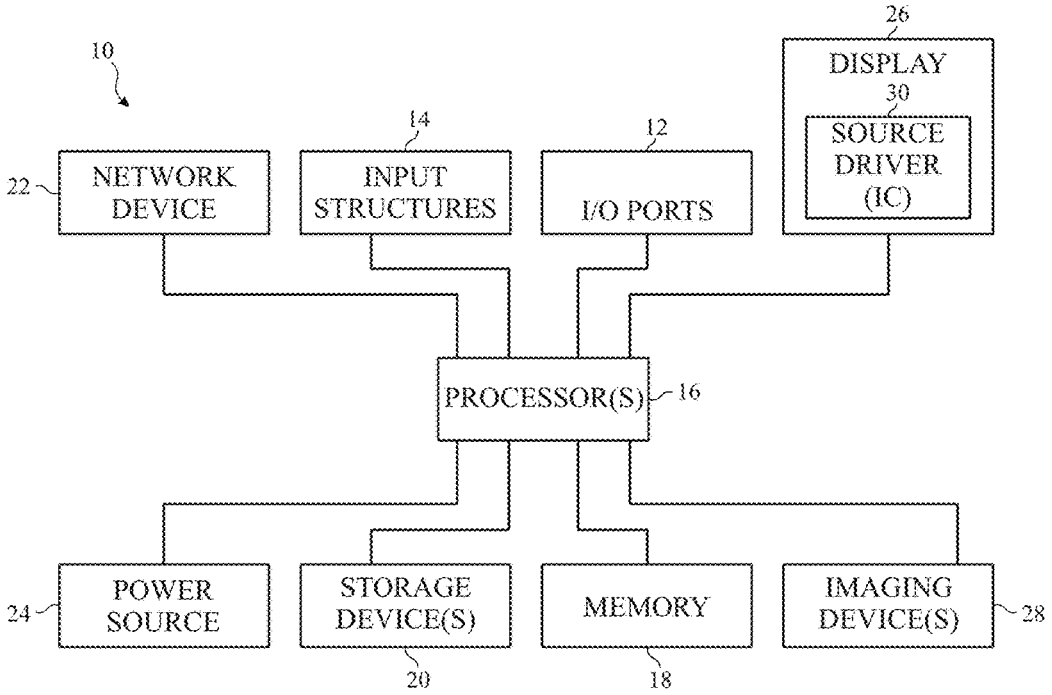
FIG. 1 is a simplified block diagram of components of an electronic device that may depict image data on a display, in accordance with embodiments described herein.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As mentioned above, in certain embodiments, a display of an electronic device may include a gate driver integrated circuit (IC) and/or a column driver IC with logic that may modify the data line signals provided to certain pixels of a display panel to compensate for the coupling effect that may be present on a pixel of the display panel. Generally, at or near a cross-point pixel where a voltage-gate line (v-gate line) couples to a gate line, a corresponding data line signal received via a source line parallel to the v-gate line at the cross-point pixel may experience a voltage kick back due to the coupling effect between the v-gate line and the source line. The voltage kick back may occur when the gate when the gate driver IC turns a corresponding gate at the cross-point pixel off (e.g., switches voltage from high to low) due to the coupling effect between the v-gate line and the source line. For example, when a voltage signal provided to a gate line via the v-gate line at a cross-point pixel changes from high to low, the voltage signal provided to the cross-point pixel via the source line may decrease due to the coupling effect. As a result, the pixel may depict a gray level illumination that is less than the desired gray level for the pixel as per the desired image data. As such, in one embodiment, the gate driver IC may increase an amplitude or value of the data line signal provided to the cross-point pixel based on the expected coupling effect for the cross-point pixel. As a result, when the voltage signal provided to the cross-point pixel via the source line decreases due to the coupling effect, the resulting voltage signal is still at a desired voltage level as specified by the corresponding image data. As a result, the undesired visual effects that may occur due to the coupling effect between the source lines and v-gate lines may be minimized, thereby improving the quality of the image data depicted on the display panel while minimizing the bezel region of the electronic display.

By way of introduction, FIG. 1 is a block diagram illustrating an example of an electronic device 10 that may include the gate driver and column driver circuitry mentioned above. The electronic device 10 may be any suitable electronic device, such as a laptop or desktop computer, a mobile phone, a digital media player, television, or the like. By way of example, the electronic device 10 may be a portable electronic device, such as a model of an iPod® or iPhone®, available from Apple Inc. of Cupertino, Calif. The electronic device 10 may be a desktop or notebook computer, such as a model of a MacBook®, MacBook® Pro, MacBook Air®, iMac®, Mac® Mini, or Mac Pro®, available from Apple Inc. In other embodiments, electronic device 10 may be a model of an electronic device from another manufacturer.

As shown in FIG. 1, the electronic device 10 may include various components. The functional blocks shown in FIG. 1 may represent hardware elements (including circuitry), software elements (including code stored on a computer-readable medium) or a combination of both hardware and software elements. In the example of FIG. 1, the electronic device 10 includes input/output (I/O) ports 12, input structures 14, one or more processors 16, a memory 18, nonvolatile storage 20, networking device 22, power source 24, display 26, and one or more imaging devices 28. It should be appreciated, however, that the components illustrated in FIG. 1 are provided only as an example. Other embodiments of the electronic device 10 may include more or fewer components. To provide one example, some embodiments of the electronic device 10 may not include the imaging device(s) 28.

Before continuing further, it should be noted that the system block diagram of the device 10 shown in FIG. 1 is intended to be a high-level control diagram depicting various components that may be included in such a device 10. That is, the connection lines between each individual component shown in FIG. 1 may not necessarily represent paths or directions through which data flows or is transmitted between various components of the device 10. Indeed, as discussed below, the depicted processor(s) 16 may, in some embodiments, include multiple processors, such as a main processor (e.g., CPU), and dedicated image and/or video processors. In such embodiments, the processing of image data may be primarily handled by these dedicated processors, thus effectively offloading such tasks from a main processor (CPU).

Considering each of the components of FIG. 1, the I/O ports 12 may represent ports to connect to a variety of devices, such as a power source, an audio output device, or other electronic devices. The input structures 14 may enable user input to the electronic device, and may include hardware keys, a touch-sensitive element of the display 26, and/or a microphone.

The processor(s) 16 may control the general operation of the device 10. For instance, the processor(s) 16 may execute an operating system, programs, user and application interfaces, and other functions of the electronic device 10. The processor(s) 16 may include one or more microprocessors and/or application-specific microprocessors (ASICs), or a combination of such processing components. For example, the processor(s) 16 may include one or more instruction set (e.g., RISC) processors, as well as graphics processors (GPU), video processors, audio processors and/or related chip sets. As may be appreciated, the processor(s) 16 may be coupled to one or more data buses for transferring data and instructions between various components of the device 10. In certain embodiments, the processor(s) 16 may provide the processing capability to execute an imaging applications on the electronic device 10, such as Photo Booth®, Aperture®, iPhoto®, Preview®, iMovie®, or Final Cut Pro® available from Apple Inc., or the "Camera" and/or "Photo" applications provided by Apple Inc. and available on some models of the iPhone®, iPod®, and iPad®.

A computer-readable medium, such as the memory 18 or the nonvolatile storage 20, may store the instructions or data to be processed by the processor(s) 16. The memory 18 may include any suitable memory device, such as random access memory (RAM) or read only memory (ROM). The nonvolatile storage 20 may include flash memory, a hard drive, or any other optical, magnetic, and/or solid-state storage media. The memory 18 and/or the nonvolatile storage 20 may store firmware, data files, image data, software programs and applications, and so forth.

The network device 22 may be a network controller or a network interface card (NIC), and may enable network communication over a local area network (LAN) (e.g., Wi-Fi), a personal area network (e.g., Bluetooth), and/or a wide area network (WAN) (e.g., a 3G or 4G data network). The power source 24 of the device 10 may include a Li-ion battery and/or a power supply unit (PSU) to draw power from an electrical outlet or an alternating-current (AC) power supply.

The display 26 may display various images generated by device 10, such as a GUI for an operating system or image data (including still images and video data). The display 26 may be any suitable type of display, such as a liquid crystal display (LCD), plasma display, or an organic light emitting diode (OLED) display, for example. Additionally, as mentioned above, the display 26 may include a touch-sensitive element that may represent an input structure 14 of the electronic device 10. The imaging device(s) 28 of the electronic device 10 may represent a digital camera that may acquire both still images and video. Each imaging device 28 may include a lens and an image sensor capture and convert light into electrical signals.

In certain embodiments, the electronic device 10 may include a source driver integrated circuit (IC) 30, which may be separate or integral to the display 26. The source driver IC 30 may include a chip, such as processor or ASIC, that may control various aspects of the display 26. For instance, the source driver IC 30 may receive image data from the processor 16 and send corresponding image signals to pixels that are part of the display 26 via source lines of the display 26. As such, the source driver IC 30 may enable the display 26 to depict images that correspond to the image data. To depict the images, the source driver IC 30 may send a digital level value to each image pixel of the display 26 via the source lines. The digital level value typically represents a shade of darkness or brightness between black and white and may be commonly referred to as gray levels.

Figure 2:
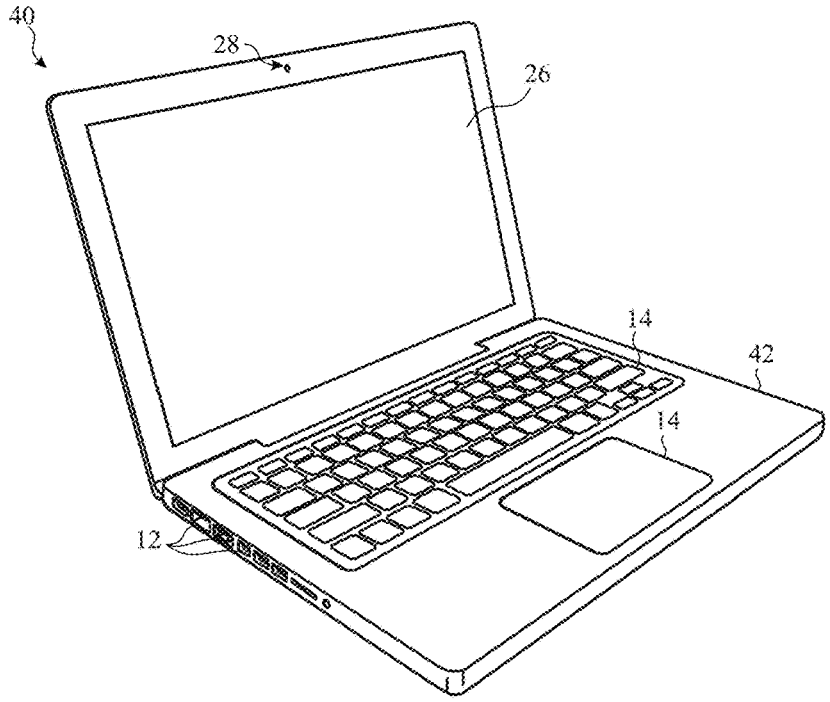
FIG. 2 is a perspective view of the electronic device of FIG. 1 in the form of a notebook computing device, in accordance with embodiments described herein.

As mentioned above, the electronic device 10 may take any number of suitable forms. Some examples of these possible forms appear in FIGS. 2-5. Turning to FIG. 2, a notebook computer 40 may include a housing 42, the display 26, the I/O ports 12, and the input structures 14. The input structures 14 may include a keyboard and a touchpad mouse that are integrated with the housing 42. Additionally, the input structure 14 may include various other buttons and/or switches which may be used to interact with the computer 40, such as to power on or start the computer, to operate a GUI or an application running on the computer 40, as well as adjust various other aspects relating to operation of the computer 40 (e.g., sound volume, display brightness, etc.). The computer 40 may also include various I/O ports 12 that provide for connectivity to additional devices, as discussed above, such as a FireWire® or USB port, a high definition multimedia interface (HDMI) port, or any other type of port that is suitable for connecting to an external device. Additionally, the computer 40 may include network connectivity (e.g., network device 24), memory (e.g., memory 18), and storage capabilities (e.g., storage device 20), as described above with respect to FIG. 1.

The notebook computer 40 may include an integrated imaging device 28 (e.g., a camera). In other embodiments, the notebook computer 40 may use an external camera (e.g., an external USB camera or a "webcam") connected to one or more of the I/O ports 12 instead of or in addition to the integrated imaging device 28. In certain embodiments, the depicted notebook computer 40 may be a model of a MacBook®, MacBook® Pro, MacBook Air®, or PowerBook® available from Apple Inc. In other embodiments, the computer 40 may be portable tablet computing device, such as a model of an iPad® from Apple Inc.

Figure 3:
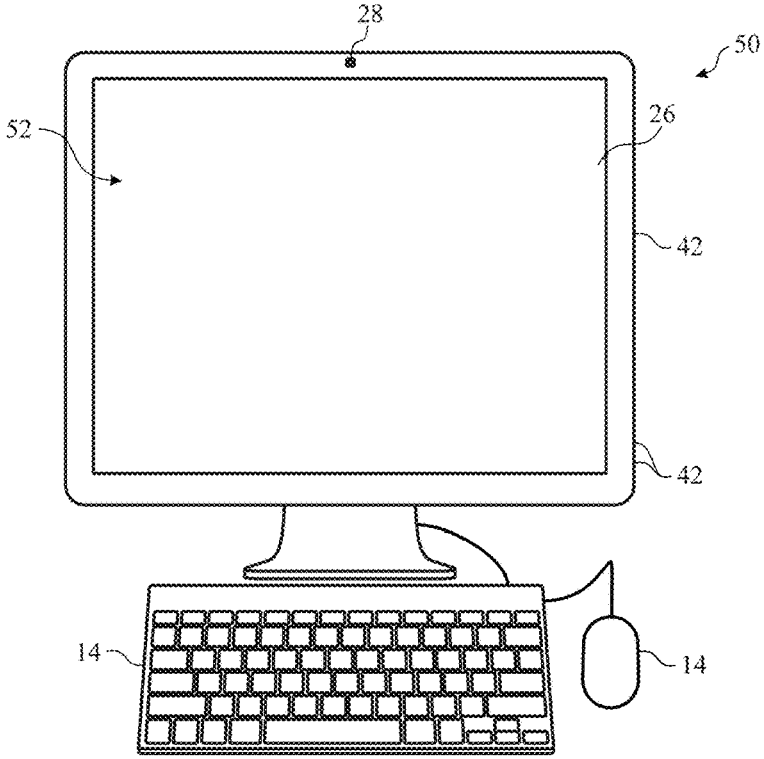
FIG. 3 is a front view of the electronic device of FIG. 1 in the form of a desktop computing device, in accordance with embodiments described herein.

FIG. 3 shows the electronic device 10 in the form of a desktop computer 50. The desktop computer 50 may include a number of features that may be generally similar to those provided by the notebook computer 40 shown in FIG. 4, but may have a generally larger overall form factor. As shown, the desktop computer 50 may be housed in an enclosure 42 that includes the display 26, as well as various other components discussed above with regard to the block diagram shown in FIG. 1. Further, the desktop computer 50 may include an external keyboard and mouse (input structures 14) that may be coupled to the computer 50 via one or more I/O ports 12 (e.g., USB) or may communicate with the computer 50 wirelessly (e.g., RF, Bluetooth, etc.). The desktop computer 50 also includes an imaging device 28, which may be an integrated or external camera, as discussed above. In certain embodiments, the depicted desktop computer 50 may be a model of an iMac®, Mac® mini, or Mac Pro®, available from Apple Inc.

Figure 4:
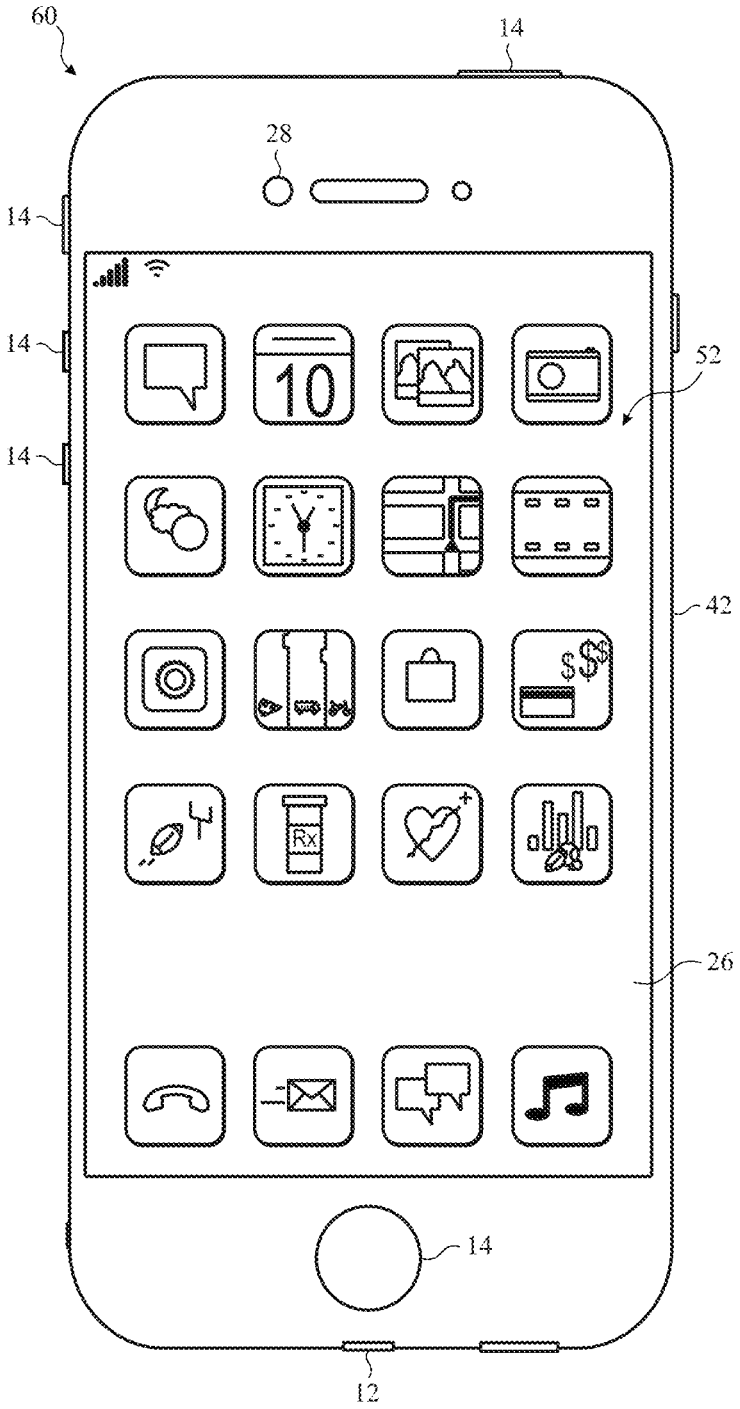
FIG. 4 is a front view of the electronic device of FIG. 1 in the form of a handheld portable electronic device, in accordance with embodiments described herein.
Figure 5:
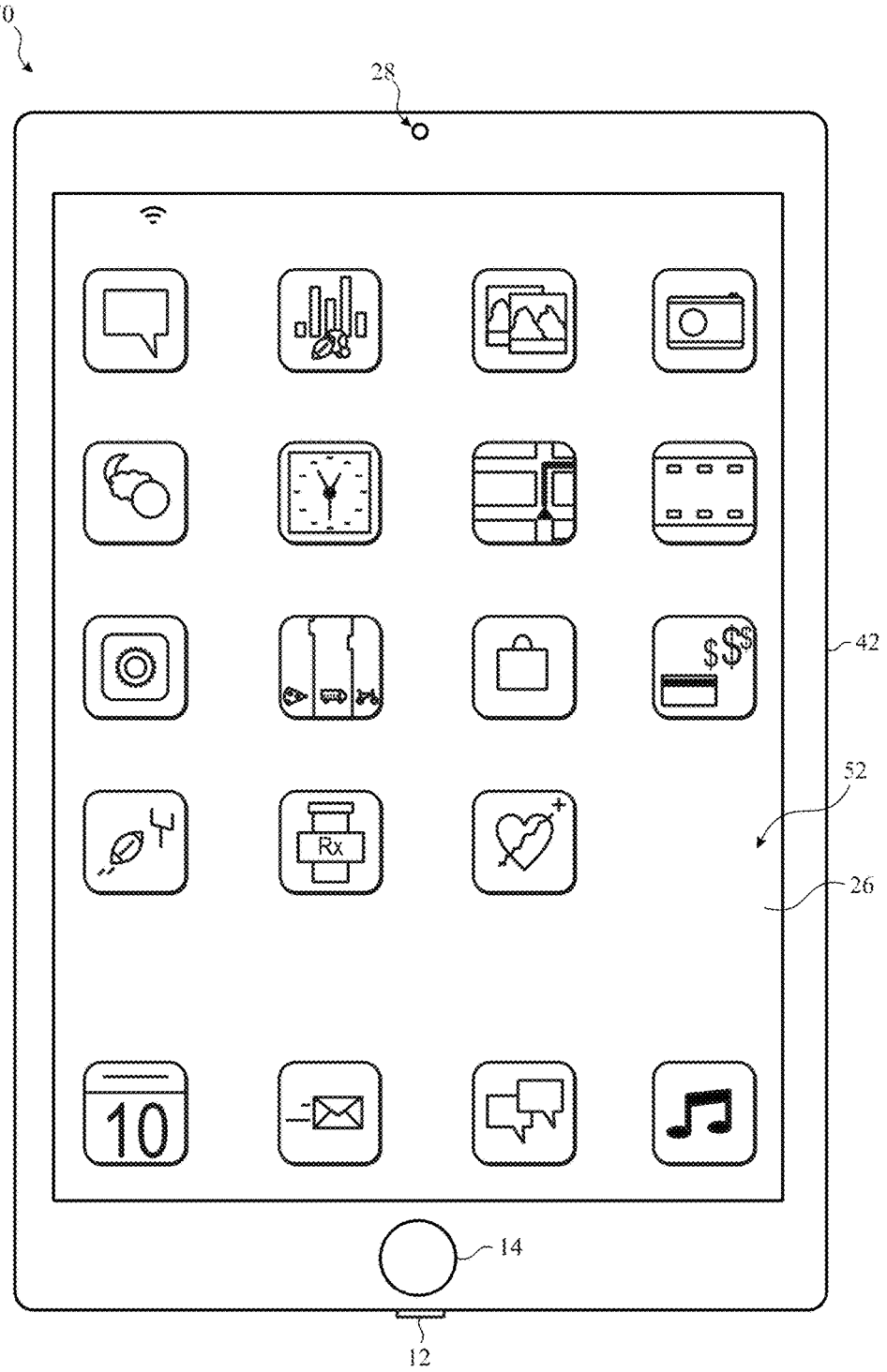
FIG. 5 is a front view of the electronic device of FIG. 1 in the form of a tablet computing device, in accordance with embodiments described herein.

The electronic device 10 may also take the form of portable handheld device 60 or 70, as shown in FIGS. 4 and 5. By way of example, the handheld device 60 or 70 may be a model of an iPod® or iPhone® available from Apple Inc. The handheld device 60 or 70 includes an enclosure 42, which may function to protect the interior components from physical damage and to shield them from electromagnetic interference. The enclosure 42 also includes various user input structures 14 through which a user may interface with the handheld device 60 or 70. Each input structure 14 may control various device functions when pressed or actuated. As shown in FIGS. 4 and 5, the handheld device 60 or 70 may also include various I/O ports 12. For instance, the depicted I/O ports 12 may include a proprietary connection port for transmitting and receiving data files or for charging a power source 24. Further, the I/O ports 12 may also be used to output voltage, current, and power to other connected devices.

The display device 26 may display images generated by the handheld device 60 or 70. For example, the display 26 may display system indicators that may indicate device power status, signal strength, external device connections, and so forth. The display 26 may also display a GUI 52 that allows a user to interact with the device 60 or 70, as discussed above with reference to FIG. 3. The GUI 52 may include graphical elements, such as the icons, which may correspond to various applications that may be opened or executed upon detecting a user selection of a respective icon.

Figure 6:
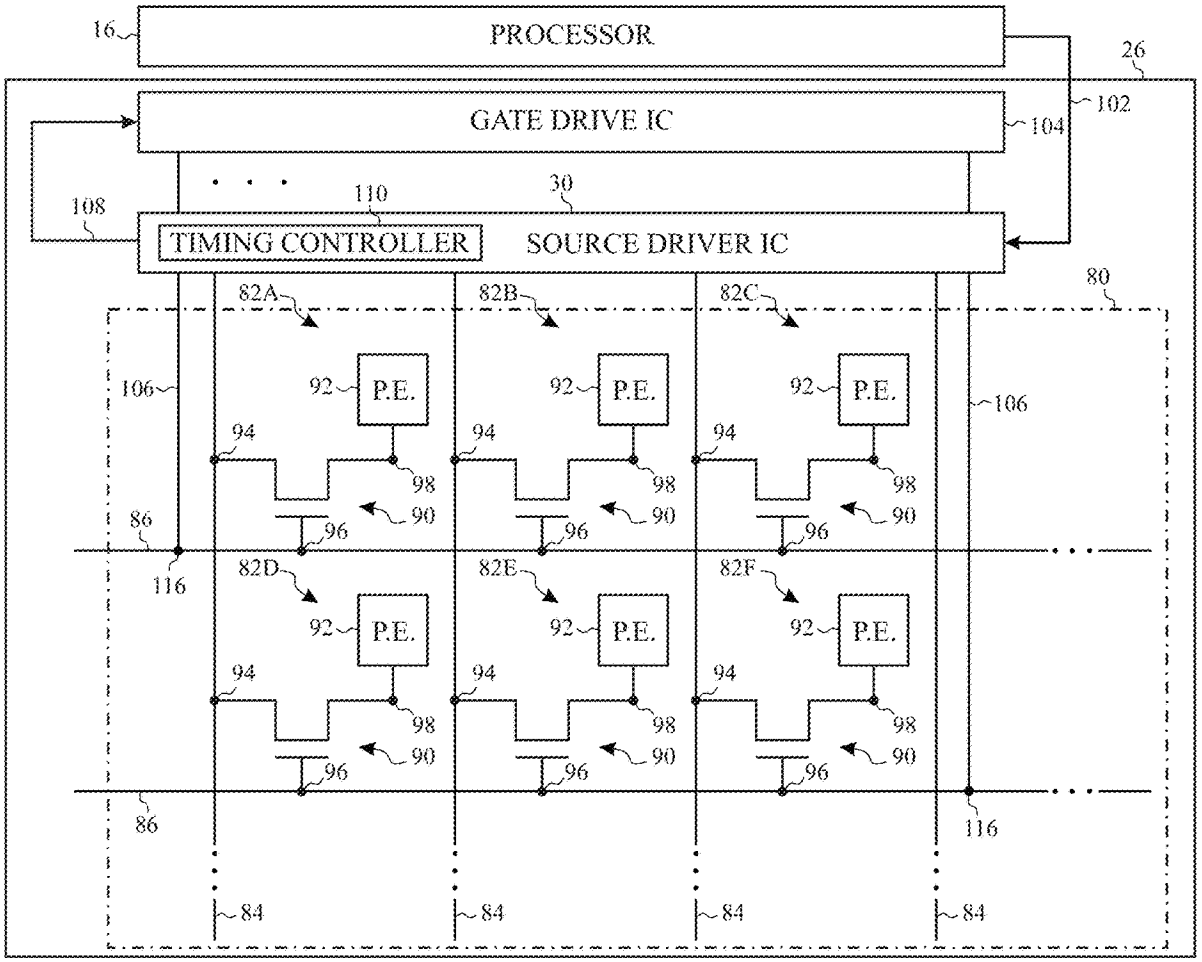
FIG. 6 is a circuit diagram illustrating an example of switching and display circuitry that may be included in the display of the electronic device of FIG. 1, in accordance with aspects of the present disclosure.

Having provided some context with regard to possible forms that the electronic device 10 may take, the present discussion will now focus on the source driver IC 30 of FIG. 1. Generally, the brightness depicted by each respective pixel in the display 26 is generally controlled by varying an electric field associated with each respective pixel in the display 26. Keeping this in mind, FIG. 6 illustrates one embodiment of a circuit diagram of display 26 that may generate the electrical field that energizes each respective pixel and causes each respective pixel to emit light at an intensity corresponding to an applied voltage. As shown, display 26 may include display panel 80. Display panel 80 may include a plurality of unit pixels 82 disposed in a pixel array or matrix defining a plurality of rows and columns of unit pixels that collectively form an image viewable region of display 26. In such an array, each unit pixel 82 may be defined by the intersection of rows and columns, represented here by the illustrated gate lines 86 (also referred to as "scanning lines") and source lines 84 (also referred to as "data lines"), respectively.

Although only six unit pixels, referred to individually by the reference numbers 82*a*-82*f*, respectively, are shown in the present example for purposes of simplicity, it should be understood that in an actual implementation, each source line 84 and gate line 86 may include hundreds or even thousands of unit pixels. By way of example, in a color display panel 80 having a display resolution of 1024×768, each source line 84, which may define a column of the pixel array, may include 768 unit pixels, while each gate line 86, which may define a row of the pixel array, may include 1024 groups of unit pixels, wherein each group includes a red, blue, and green pixel, thus totaling 3072 unit pixels per gate line 86. In the context of LCDs, the color of a particular unit pixel generally depends on a particular color filter that is disposed over a liquid crystal layer of the unit pixel. In the presently illustrated example, the group of unit pixels 82*a*-82*c* may represent a group of pixels having a red pixel (82*a*), a blue pixel (82*b*), and a green pixel (82*c*). The group of unit pixels 82*d*-82*f* may be arranged in a similar manner.

As shown in the present figure, each unit pixel 82*a*-82*f* includes a thin film transistor (TFT) 90 for switching a respective pixel electrode 92. In the depicted embodiment, the source 94 of each TFT 90 may be electrically connected to a source line 84. Similarly, the gate 96 of each TFT 90 may be electrically connected to a gate line 86. Furthermore, the drain 98 of each TFT 90 may be electrically connected to a respective pixel electrode 92. Each TFT 90 serves as a switching element which may be activated and deactivated (e.g., turned on and off) for a predetermined period based upon the respective presence or absence of a scanning signal at gate 96 of TFT 90. For instance, when activated, TFT 90 may store the image signals received via a respective source line 84 as a charge in pixel electrode 92. The image signals stored by pixel electrode 92 may be used to generate an electrical field that energizes the respective pixel electrode 92 and causes the pixel 82 to emit light at an intensity corresponding to the voltage applied by the source line 84. For instance, in an LCD panel, such an electrical field may align liquid crystals molecules within a liquid crystal layer to modulate light transmission through the liquid crystal layer.

In certain embodiments, the display 26 may further include the source driver integrated circuit (source driver IC) 30, which may include a chip, such as a processor or ASIC, that may control various aspects of display 26 and panel 80. For example, source driver IC 30 may receive image data 102 from processor(s) 16 and send corresponding image signals to unit pixels 82*a*-82*f* of panel 80. Source driver IC 30 may also be coupled to gate driver IC 104, which may be configured to activate or deactivate pixels 82 via gate lines 86 and voltage gate lines (v-gate lines) 106. As such, source driver IC 30 may send timing information, shown here by reference number 108, via a timing controller 110 to gate driver IC 104 to facilitate activation/deactivation of individual rows of pixels 82. While the illustrated embodiment shows a single source driver IC 30 coupled to panel 80 for purposes of simplicity, it should be appreciated that additional embodiments may utilize a plurality of source driver ICs 30. For example, additional embodiments may include a plurality of source driver ICs 30 disposed along one or more edges of panel 80, wherein each source driver IC 30 is configured to control a subset of source lines 84 and/or gate lines 86.

The v-gate lines 106 may be disposed parallel to the source lines 84. In certain embodiments, the v-gate lines 106 may be disposed underneath or above the source lines 84 on a different layer of the panel 80. In any case, the v-gate lines 106 may provide gate voltage signals to the gate lines 86 to control the operation of the TFT 90. By employing v-gate lines 106 and gate lines 86, the gate driver IC 104 may be positioned along the same edge of the panel 80 as the source driver IC 30. As a result, the other edges of the panel 80 may include less circuitry and thus may be designed to form a variety of different shapes and reduce the size of the respective bezel regions.

In operation, source driver IC 30 receives image data 102 from processor 16 and, based on the received data, outputs signals to control pixels 82. To display image data 102, source driver IC 30 may adjust the voltage of pixel electrodes 92 (abbreviated in FIG. 4 as P.E.) one row at a time. To access an individual row of pixels 82, gate driver IC 104 may send an activation signal to TFTs 90 associated with the particular row of pixels 82 being addressed. This activation signal may render the TFTs 90 on the addressed row conductive. Accordingly, image data 102 corresponding to the addressed row may be transmitted from source driver IC 30 to each of the unit pixels 82 within the addressed row via respective data lines 84. Thereafter, gate driver IC 104 may deactivate TFTs 90 in the addressed row, thereby impeding the pixels 82 within that row from changing state until the next time they are addressed. The above-described process may be repeated for each row of pixels 82 in panel 80 to reproduce image data 102 as a viewable image on display 26.

In sending image data to each of the pixels 82, a digital image is typically converted into numerical data so that it can be interpreted by a display device. For instance, the image 102 may itself be divided into small "pixel" portions, each of which may correspond to a respective pixel 82 of panel 80. To avoid confusion with the physical unit pixels 82 of the panel 80, the pixel portions of the image 102 shall be referred to herein as "image pixels." Each "image pixel" of image 102 may be associated with a numerical value, which may be referred to as a "data number" or a "digital luminance level," that quantifies the luminance intensity (e.g., brightness or darkness) of the image 102 at a particular spot. The digital level value of each image pixel typically represents a shade of darkness or brightness between black and white, commonly referred to as gray levels. As will be appreciated, the number of gray levels in an image usually depends on the number of bits used to represent pixel intensity levels in a display device, which may be expressed as $2^N$ gray levels, where N is the number of bits used to express a digital level value. By way of example, in an embodiment where display 26 is a "normally black" display using 8 bits to represent a digital level, display 10 may be capable of providing 256 gray levels to display an image, wherein a digital level of 0 corresponds to full black (e.g., no transmittance), and a digital level of 255 correspond to full white (e.g., full transmittance). In another embodiment, if 6 bits are used to represent a digital level, then 64 gray levels may be available for displaying an image.

To provide some examples, in one embodiment, source driver IC 30 may receive an image data stream equivalent to 24 bits of data, with 8-bits of the image data stream corresponding to a digital level for each of the red, green, and blue color channels corresponding to a pixel group including red, green, and blue unit pixel (e.g., 82*a*-82*c* or 82*d*-82*f*). In another embodiment, source driver IC 30 may receive 18-bits of data in an image data stream, with 6-bits of the image data corresponding to each of the red, green, and blue color channels, for example. Further, although digital levels corresponding to luminance are generally expressed in terms of gray levels, where a display utilizes multiple color channels (e.g., red, green, blue), the portion of the image corresponding to each color channel may be individually expressed as in terms of such gray levels. Accordingly, while the digital level data for each color channel may be interpreted as a grayscale image, when processed and displayed using unit pixels 82 of panel 80, color filters (e.g., red, blue, and green) associated with each unit pixel 82 allows the image to be perceived as a color image.

Figure 7:
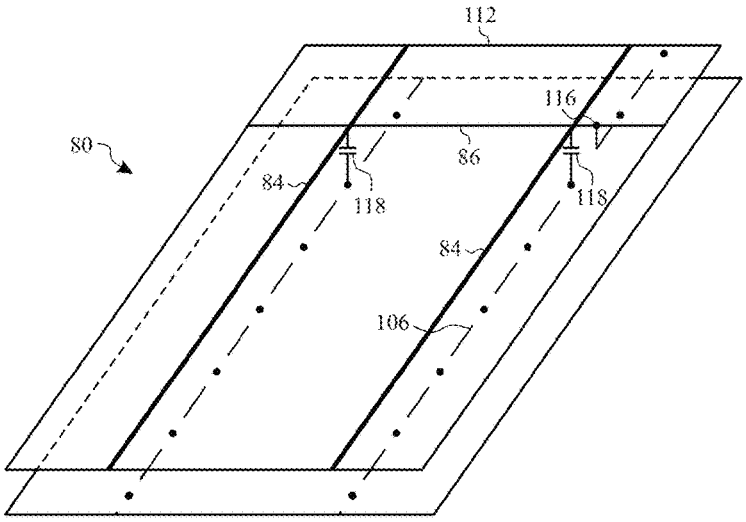
FIG. 7 is a circuit diagram illustrating example layouts of voltage-gate lines (v-gate lines), gate lines, and source lines that may be part of the display in the electronic device of FIG. 1, in accordance with aspects of the present disclosure.

With the foregoing in mind, FIG. 7 illustrates an exploded perspective view of the panel 80. As shown in FIG. 7, the panel 80 may include a layer 112 and a layer 114. The layer 112 may include the source lines 84 and the gate lines 86. The layer 114 may include the v-gate lines 106, and the v-gate lines 106 may electrically couple to the gate line 86 via a cross point node 116. The v-gate line 106 may couple to the gate line 86 at the cross point node 116 using metal vias or the like. Generally, each v-gate line 106 may couple to a respective gate line 86 via a respective cross point node 116. As such, signals generated by the gate driver IC 104 may be provided to the gate line 86 via the cross point node 116 and the v-gate lines 106. In operation, when providing voltage signals to the gate line 86, the voltage applied to the TFT 90 of a respective may be a high or low voltage used to activate or deactivate the pixel electrode 92 of the respective pixel 82.

Figure 8:
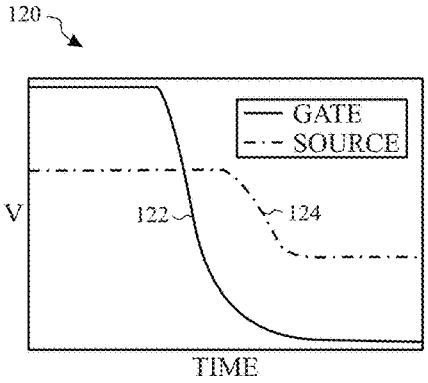
FIG. 8 is a graph of expected voltage and data line signals received by a pixel of the display in the electronic device of FIG. 1 via a respective gate line and a respective source line, in accordance with aspects of the present disclosure.

In some cases, when transitioning from a high voltage to a low voltage, the expected signal received by the respective pixel electrode 92 via the gate line 86 may correspond to the voltage signal 122 depicted in the graph 120 of FIG. 8. In the same manner, the expected signal received by the respective pixel electrode 92 via the respective source line 84 may correspond to the data line signal 124.

However, due to the proximity between each respective source line 84 and each respective v-gate line 106, the cross point node 116 may experience a voltage kickback disturbance. This kickback disturbance is caused due to a coupling effect that occurs between the v-gate line 106 and source line 84. That is, since the v-gate line 106 may be disposed underneath the source line 84, a coupling effect may be induced due to the respective voltages present on each line. Generally, the kickback disturbance may be more pronounced at a pixel located near a cross point node 116, as compared to pixels located further away from the cross point node 116.

Figure 9:
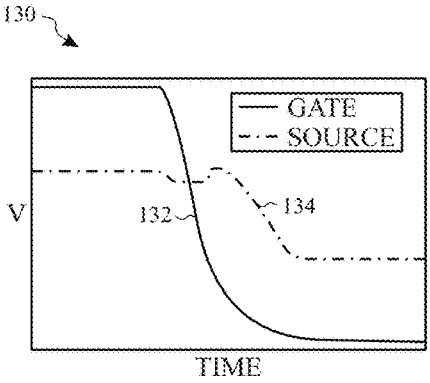
FIG. 9 is a graph of example voltage and data line signals received by a pixel of the display in the electronic device of FIG. 1 via a respective gate line and a respective source line, in accordance with aspects of the present disclosure.

For instance, FIG. 9 depicts a graph 130 that illustrates an example data line signal that may experience a kickback disturbance induced by the coupling effect between the source line 86 and the v-gate line 106. As shown in FIG. 9, a voltage signal 132 may represent a voltage of a respective gate line 86, and a data line signal 134 may represent a voltage received by the respective pixel electrode 92 via a respective source line 84. When the voltage signal 132 transitions from high to low, the respective pixel electrode 92 may receive a kickback disturbance or voltage disturbance that may distort the data line signal 134 being transmitted via the respective source line 86. That is, the kickback voltage may be induced from a gate coupling to the source line 84 above the v-gate line 106. The kickback voltage may then be transferred through the respective TFT 90 to the respective pixel electrode 92 during gate turn off or turn on. In the example depicted in FIG. 9, the data line signal 134 may decrease when the voltage signal 132 transitions from high to low. As a result, the respective pixel electrode 92 may not produce a desired brightness or grey level, as specified by the image data 102.

Referring back to FIG. 7, the kickback disturbance or voltage may be generated due at least partly to a coupling effect between the source line 84 and the v-gate line 106. The coupling effect is represented in the panel 80 of FIG. 7 as a capacitance 118 between the source line 84 and the v-gate line 106. As mentioned above, the pixels 82 located at or near the cross point nodes 116 may experience a larger amount of kickback voltage as compared to other pixels along the respective gate line 86. In some cases, the kickback voltage may be up to 300 mV, which may distort the images depicted on the display 26.

Figure 10:
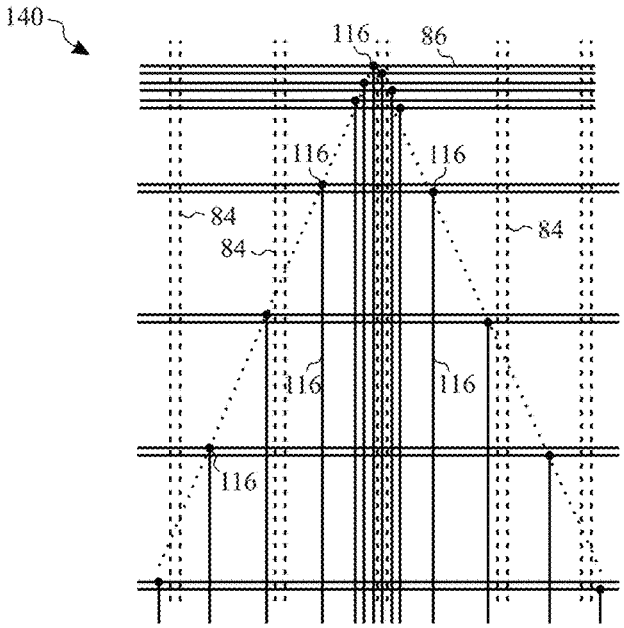
FIG. 10 is a circuit diagram illustrating locations of cross-point pixels of the display in the electronic device of FIG. 1, in accordance with aspects of the present disclosure.

Keeping this in mind, FIG. 10 is an example layout 140 that illustrates sample positions of cross point nodes 116 with respect to source lines 84, gate lines 86, and v-gate lines 106. Although FIG. 10 illustrates a particular layout of the cross point nodes 116, it should be understood that, in other embodiments, the cross point nodes 116 may be positioned in other arrangements.

Figure 11:
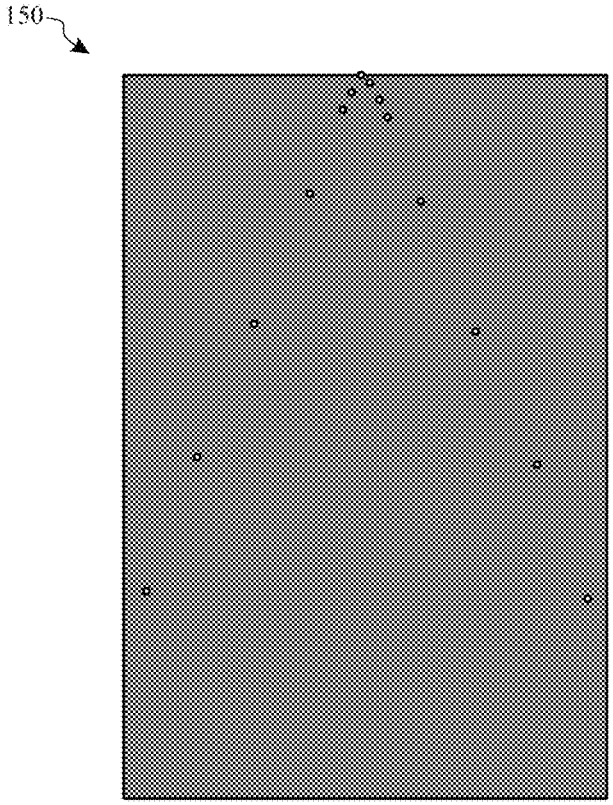
FIG. 11 is an illustration of visual effects that may be depicted in the display in the electronic device of FIG. 1, in accordance with aspects of the present disclosure.

FIG. 11 illustrates an example image 150 depicted on the display 26 having the cross point nodes 116 positioned according to the layout of FIG. 10. The example image 150 may depict image data that displays the same grey level value for each pixel in the example image 150. However, as shown in the example image 150 of FIG. 10, the pixels located at or near the cross point nodes 116 each have a lower grey level, as compared to the remaining pixels in the example image 150. This reduced grey level may be induced by the coupling effect between the source lines 84 and the v-gate lines 106 discussed above.

Figure 12:
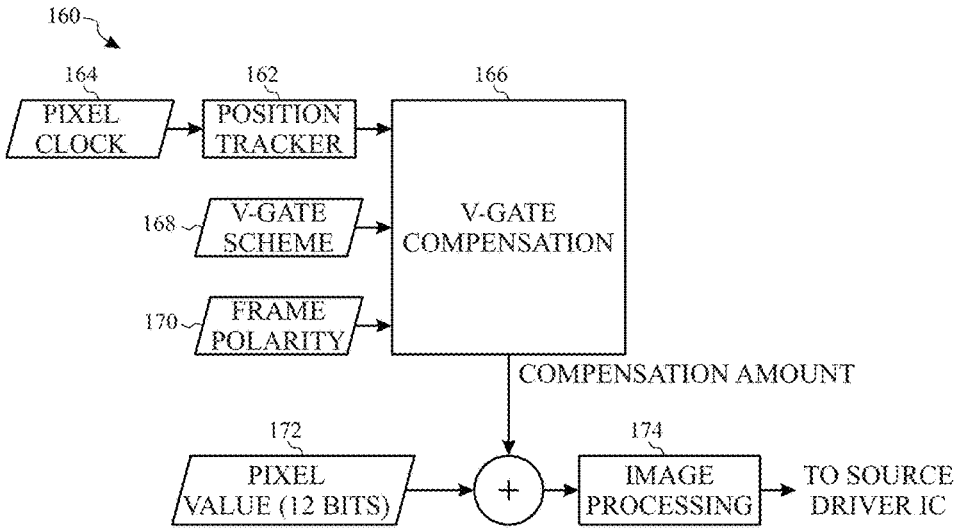
FIG. 12 is a block diagram illustrating logic components that may be employed within circuitry of the display in the electronic device of FIG. 1 to compensate for coupling effects that may be present on certain pixels of the display, in accordance with aspects of the present disclosure.

With the foregoing in mind, FIG. 12 illustrates a block diagram of logic components 160 that may be executed by circuitry disposed on the source driver IC, the gate driver IC 104, the timing controller 110, or the like. That is, the logic components 160 may be executed by one or more processors or logic circuitry disposed on the source driver IC, the gate driver IC 104, the timing controller 110, or the like. Generally, the logic components 160 may adjust voltage signals provided by the source driver IC 30 via the source lines 84 to compensate for the coupling effect that may occur between the source lines 84 and the v-gate lines 106 discussed above.

In one embodiment, position tracker logic 162 may receive pixel clock information 164 from the processor 16 via the image data 102. The pixel clock information 164 may indicate a current pixel being processed for display by, for example, the source driver IC 30. Using the pixel clock information 164, the position tracker logic 162 may determine a location of the respective pixel being processed. The position tracker logic 162 may then provide a respective position of the respective pixel with respect to the panel 80 to v-gate compensation logic 166. The v-gate compensation logic 166 may receive the respective position of the respective pixel, v-gate scheme information 168, and frame polarity information 170. The v-gate scheme information 168 may detail the scheme in which the v-gate lines 106 are disposed within the panel 80. In particular, the v-gate scheme information 168 may indicate locations in which each v-gate line 106 couples to a respective gate line 86. As such, the v-gate scheme information 168 may provide information regarding locations of cross point nodes 116 with respect to the panel 80.

In addition to the v-gate scheme information 168, the v-gate compensation logic 166 may receive frame polarity information 170, which may detail a polarity of a respective frame associated with the respective pixel provided in the pixel clock information. The frame polarity information 170 may indicate whether the polarity of the voltage applied to the respective pixel is positive or negative. If the frame polarity is positive, the v-gate compensation logic 166 may increase the voltage signal provided via the source line 86 to compensate for the coupling effect that may be present on the respective pixel. If, however, the frame polarity is negative, the v-gate compensation logic 166 may again increase the voltage signal provided via the source line 86 to compensate for the coupling effect that may be present on the respective pixel. However, if e frame polarity is negative, the magnitude of the increase in voltage signal provided by the v-gate compensation logic 166 may be smaller than the magnitude of the increase in the voltage signal provided by the v-gate compensation logic 166 when the frame polarity is negative.

After receiving the position information, the v-gate scheme information 168, and the frame polarity information 170, the v-gate compensation logic 166 may determine a compensation amount for the data line signal provided to the respective pixel via the source line 84. The compensation amount may be determined based on the position information, the v-gate scheme information 168, and the frame polarity information 170. For instance, the v-gate compensation logic 166 may determine whether the respective pixel is located at or near a cross point node 116 based on the position information and the v-gate scheme information 168. In certain embodiments, the v-gate compensation logic 166 may just determine a compensation amount for the data line signals for pixels located at or near the cross point nodes 116. In other embodiments, after determining the compensation amount for the data line signals for pixels located at or near the cross point nodes 116, the v-gate compensation logic 166 may proportionally adjust the compensation amounts for the other pixels located away from the cross point node 116 based on a distance between the pixel and the cross point node 116.

In addition to the position information and the v-gate scheme information 168, the v-gate compensation logic 166 may determine the compensation amount for the respective data line signal of the respective pixel based on the frame polarity information 170. As mentioned above, the frame polarity information 170 may indicate whether the data line signal provided to the respective pixel is positive or negative. In one embodiment, if the data line signal is negative, the compensation amount determined by the v-gate compensation logic 166 may have a smaller amplitude as compared to a corresponding compensation amount determined by the v-gate compensation logic 166 for similarly positioned pixel under a similar v-gate scheme that has a positive polarity.

With regard to the compensation amount, in certain embodiments, the adjustment amounts may be predetermined based on one or more simulations of image data depicted on the display 26 during manufacturing of the display 26. The simulations may simulate an expected coupling effect on pixels of the display 26. A respective compensation amount may then be determined based an expected effect to the voltage signal for each respective pixel. The compensation amount may be determined based on providing a voltage level sufficient enough to maintain a desired voltage level for the respective pixel with the presence of the coupling effect. Additional details with regard to the compensation amount provided by the v-gate compensation logic will be detailed below with reference to FIG. 13.

The v-gate compensation logic 166 may store the compensation amounts in a look up table (LUT) or some other storage unit (e.g., storage device 20). In one embodiment, the v-gate compensation logic 166 may determine compensation amounts for certain pixels located at certain positions on the panel 80 using simulations or other algorithms. After determining these compensation amounts and storing the amounts in the LUT, the v-gate compensation logic may perform linear interpolations between points in the LUT to determine additional compensation amounts for various other pixels in the panel 80 that have not been previously determined. Generally, the linear interpolation may be a linear adjustment as a function of vertical height or length of the v-gate line 106 with respect to the respective pixel.

After determining the compensation amounts, the compensation amount may be added to a pixel value 172 (e.g., data line signal) for the respective pixel. The pixel value 172 may be determined based on the image data 102 described above. As such, the pixel value 172 may correspond to a grey level to be depicted by the respective pixel. The pixel value 172 may be added to the compensation amount and the resulting data line signal may be provided to image processing logic 174. The image processing logic 174 may process the image data 102 to perform various functions such as white point compensation, dithering compensation, and various other image processing effects, to display the resulting image data 102 on the display 26. After the image processing logic 174 performs its processing, the image processing logic 174 may send the processed image data, including a respective compensated data line signal, to each respective pixel via a respective source line 84.

Figure 13:
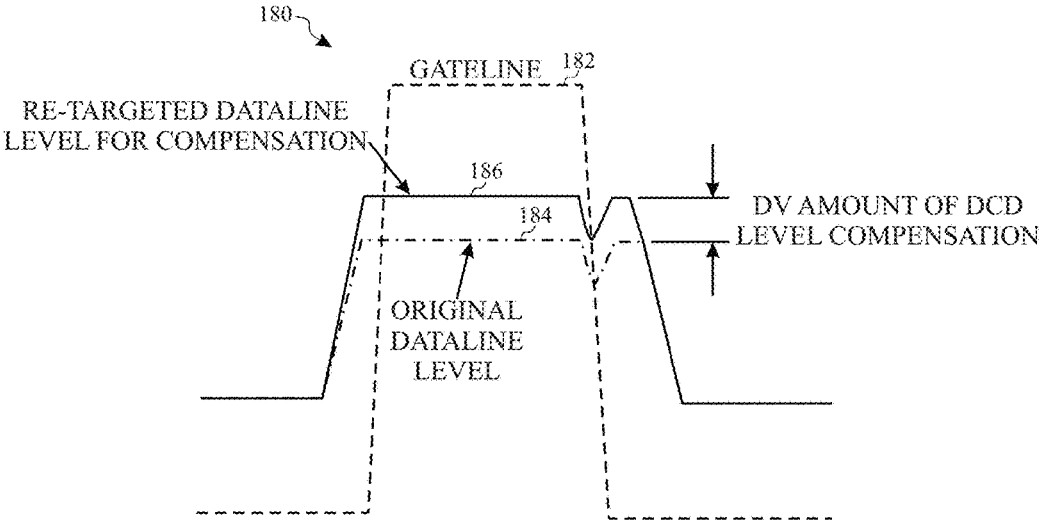
FIG. 13 is a graph of example voltage and data line signals transmitted to a pixel of the display in the electronic device of FIG. 1 via a respective gate line and a respective source line to compensate for coupling effects that may occur between the respective gate line and the respective source line, in accordance with aspects of the present disclosure.

With the foregoing in mind, FIG. 13 illustrates a graph 180 of example voltage and data line signals transmitted to a pixel of the display 26 via a respective gate line 86 and via a respective source line 84 to compensate for coupling effects between the respective v-gate line 106 and the respective source line 84. As shown in FIG. 13, voltage signal 182 corresponds to a voltage signal provided to the respective TFT 90 of a respective pixel 82. Before adding a compensation amount to a voltage signal, an original voltage signal provided to a pixel is represented by voltage signal 184. As shown in the graph 180, the voltage signal 184 decreases when the voltage signal 182 transitions from high to low due to the coupling effect between the v-gate line 106 and the source line 84 described above To ensure that the respective pixel 82 receives the desired voltage level, the v-gate compensation logic 166 may determine a compensation amount, as described above. The compensation amount may then be added to the voltage signal 184 to provide a voltage signal 186. As illustrated in the graph 180, when the compensation amount is added to the original voltage signal 184, the compensated voltage signal 186 may decrease to approximately a same value as expected to be provided by the original voltage signal 184. As such, the respective pixel 82 displays a pixel value as specified per the image data 102.

When the frame polarity is negative, it should be noted that the compensation amount may again be added to the original voltage signal 184 to compensate for the coupling effect that may occur when the voltage signal 182 transitions from high to low. However, since the frame polarity is negative, the amount of compensation may be smaller, as compared to the same pixel in a positive frame polarity.

It should be noted that in some embodiments, the compensated voltage signal 186 may be above the range of grey scale values that the pixel is capable of displaying. In these cases, the artifacts that may be present on the pixel due to the high voltage signal 186 may not be noticeable, as compared to when the pixel displays a grey level value that is lower than what is expected. That is, the visual artifacts of the pixel become more noticeable to a viewer of the display 26 as the grey scale values decrease.

Figure 14:
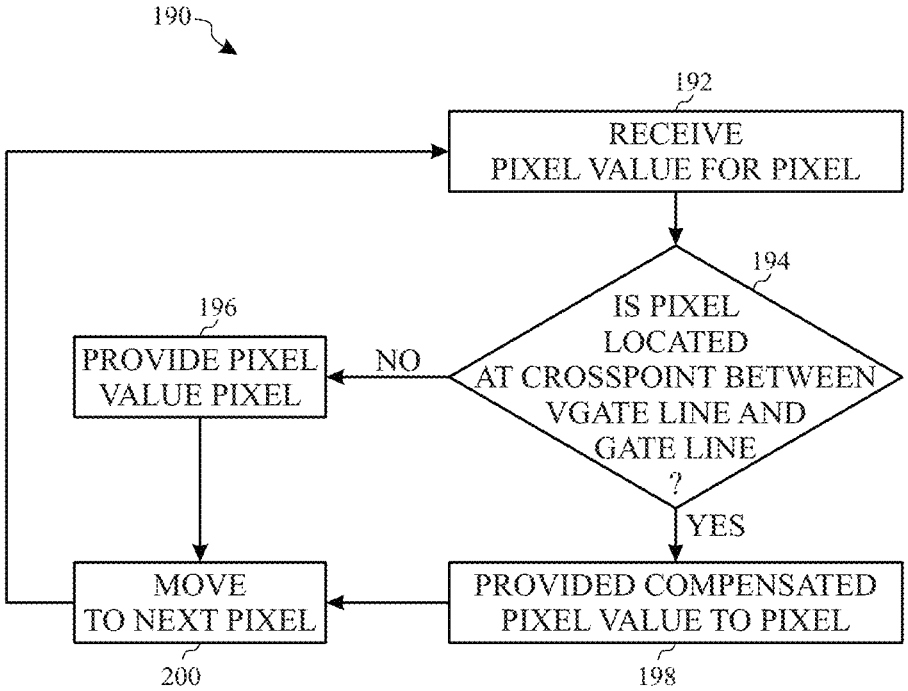
FIG. 14 is a flow chart of a method for providing a compensated data line signal to a pixel via a source line of the display in the electronic device of FIG. 1 to compensate for coupling effects that may occur between the respective v-gate line and the respective source line of the pixel, in accordance with aspects of the present disclosure.

In certain embodiments, the v-gate compensation logic 166 may be implemented by the processor 16, the source driver IC 30, the timing controller 110, the gate driver IC 104, or any other suitable device. FIG. 14 illustrates a flow chart of a method 190 for providing a compensated voltage signal to a pixel 82 via a source line 84 of the panel 80. For the purposes of discussion, the following description of the method 190 will be described as being performed by the source driver IC 30. However, it should be understood that other suitable devices may also implement the method 190.

Referring now to FIG. 14, at block 192, the source driver IC 30 may receive a pixel value (e.g., data line signal) that is to be provided to a particular pixel via a source line 84. At block 194, the source driver IC 30 may determine whether the respective pixel is located at or near a cross point node 116. As used herein, a pixel located at or near the cross point node 116 may include up to a defined number of threshold number of pixels (e.g., ten pixels) surrounding the cross point node 116.

If the respective pixel is not located at or near the cross point node 116, the source driver IC 30 may proceed to block 196 and provide the pixel value (e.g., data line signal) received at block 192 to the respective pixel via a respective source line 84. If, however, the respective pixel is located at or near the cross point node 116, the source driver IC 30 may proceed to block 198 and provide a compensated pixel value (e.g., compensated data line signal) to the respective pixel via the respective source line 84. In certain embodiments, the source driver IC 30 may determine the compensated pixel value based on the factors mentions above.

After providing the compensated pixel value to the respective pixel, the source driver IC 30 may proceed to block 200 and move to the next pixel as provided in the image data 102. As such, the source driver IC 30 may continuously perform blocks 192-198 for each pixel as indicated in the image data 102. Although the compensated pixel value may be larger than the originally pixel value specified by the image data 102, it should be noted that when a grey level depicted by a respective pixel is less than the desired grey level, the resulting artifact displayed on the display 26 is more apparent as compared to when the grey level depicted by the respective pixel is greater than the desired grey level. As such, the compensated pixel value may not significantly reduce the quality of the image data 102 displayed by the display 26.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A display device, comprising:

a source line configured to provide a data line signal to a pixel of the display device;

a gate line configured to provide a gate signal to a switches associated with the pixel;

a voltage gate line disposed parallel to the source line and coupled to the gate line at a cross point node; and a driver circuit configured to:

receive a pixel value to provide to the pixel, wherein the pixel is located at the cross point node;

determine a compensation amount for the pixel value, wherein the compensation value is configured to reduce an expected kickback voltage present on the pixel due to a coupling effect between the source line and the voltage gate line at the cross point node;

generate a compensated data line signal based on the compensation amount and the pixel value; and provide the compensated data line signal to the pixel via the source line.

2. The display device of claim 1, wherein the driver circuit is configured to determine the compensation amount based on a frame polarity associated with the pixel value.

3. The display device of claim 1, wherein the driver circuit is configured to determine the compensation amount by searching a look up table having a plurality of compensation values for a plurality of pixels of the display device.

4. The display device of claim 1, wherein the pixel value corresponds to a grey level value to be rendered by the pixel.

5. The display device of claim 1, wherein the compensated data line signal is configured to provide the pixel value to the pixel when a kickback voltage is present.

6. The display device of claim 1, wherein the driver circuit is configured to determine the compensation amount based on one or more simulations of image data depicted on the display device.

7. A method, comprising:

receiving a pixel value to provide to a pixel of an electronic display, wherein the pixel is located at a cross point node that corresponds to an intersection of a first gate line and a second gate line of the electronic display;

determining a compensation amount for the pixel value, wherein the compensation value is configured to reduce an expected kickback voltage present on the pixel due to a coupling effect between a source line and the first gate line of the electronic display at the cross point node, wherein the source line and the first gate line are parallel to each other;

generating a compensated data line signal based on the compensation amount and the pixel value; and supplying the compensated data line signal to the pixel via the source line.

8. The method of claim 7, wherein the first gate line is perpendicular to the second gate line, and wherein the first gate line is coupled to the pixel.

9. The method of claim 7, wherein determining the compensation amount for the pixel value comprises:

determining a location of the pixel with respect to the electronic display; and identifying the compensation amount based on the location and a lookup table comprising a plurality of compensation values organized according to a plurality of locations on the electronic display.

10. The method of claim 7, wherein determining the compensation amount for the pixel value comprises:

determining a location of the pixel with respect to the electronic display; and interpolating the compensation amount based on another compensation amount provided in a lookup table comprising a plurality of compensation values organized according to a plurality of locations on the electronic display.

11. The method of claim 10, wherein the compensation amount is linearly interpolated.

12. The method of claim 10, wherein the compensation amount is interpolated using a linear adjustment as a function of vertical height or length of the voltage gate line with respect to the pixel.

13. The method of claim 7, comprising performing one or more image processing operations on the compensated data line signal before supplying the compensated data line signal to the pixel.

14. The method of claim 13, wherein the one or more image processing operations comprise white point compensation, dithering compensation, or any combination thereof.

15. A system, comprising:

a display comprising a plurality of pixels, wherein the display is configured to render image data;

a plurality of gate lines configured to couple to the plurality of pixels;

a plurality of source lines configured to couple to the plurality of pixels, wherein the plurality of source lines are perpendicular to the plurality of gate lines;

a plurality of voltage gate lines configured to couple to the plurality of gate lines at a plurality of cross point nodes, wherein the plurality of voltage gate lines are parallel to the plurality of source lines;

a source driver integrated circuit (IC) configured to provide a plurality of pixel values to the plurality of pixels via the plurality of source lines, wherein the source driver IC is configured to:

receive a first pixel value to provide to a first pixel of the plurality of pixels;

determine a compensation amount for the first pixel value, wherein the compensation amount is configured to reduce an expected kickback voltage present on the first pixel, wherein the expected kickback voltage is caused by a coupling effect between a first source line of the plurality of source lines and a first voltage gate line of the plurality of voltage gate lines located at a first cross point node of the plurality of cross point nodes, wherein the first source line is coupled to the first pixel;

generate a compensated data line signal based on the compensation amount and the pixel value; and supply the compensated data line signal to the pixel via the first source line.

16. The system of claim 15, wherein the first voltage gate line is disposed directly above or directly below the first source line.

17. The system of claim 15, comprising a gate driver integrated circuit (IC) configured to couple to the plurality of gate lines.

18. The system of claim 17, wherein the gate driver IC and the source driver IC are positioned on a same side of the display.

19. The system of claim 17, wherein the plurality of cross point nodes is configured to couple the plurality of a gate lines to the plurality of voltage gate lines.

* * * * *